US009816165B2

(12) United States Patent
Li et al.

(10) Patent No.: US 9,816,165 B2
(45) Date of Patent: Nov. 14, 2017

(54) ULTRAHIGH-STRENGTH, HIGH-TOUGHNESS, WEAR-RESISTANT STEEL PLATE AND MANUFACTURING METHOD THEREOF

(71) Applicant: Baoshan Iron & Steel Co., Ltd., Shanghai (CN)

(72) Inventors: Hongbin Li, Shanghai (CN); Liandeng Yao, Shanghai (CN); Yuchuan Miao, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 157 days.

(21) Appl. No.: 14/418,417

(22) PCT Filed: Jan. 31, 2013

(86) PCT No.: PCT/CN2013/071185
§ 371 (c)(1),
(2) Date: Jan. 29, 2015

(87) PCT Pub. No.: WO2014/019353
PCT Pub. Date: Feb. 6, 2014

(65) Prior Publication Data

US 2015/0191806 A1 Jul. 9, 2015

(30) Foreign Application Priority Data

Jul. 31, 2012 (CN) ..... 2012 1 0270605

(51) Int. Cl.
*C22C 38/14* (2006.01)
*C22C 38/32* (2006.01)
(Continued)

(52) U.S. Cl.
CPC ..... *C22C 38/32* (2013.01); *C21D 1/60* (2013.01); *C21D 6/002* (2013.01); *C21D 6/005* (2013.01);
(Continued)

(58) Field of Classification Search
CPC ..... C22C 38/06; C22C 38/14; C22C 38/18; C22C 38/26; C22C 38/28; C22C 38/32
(Continued)

(56) References Cited

U.S. PATENT DOCUMENTS 6,246,760 B1 * 6/2001 Makino ..... H04M 9/082 379/406.08
8,097,099 B2 1/2012 Saitoh et al.
(Continued)

FOREIGN PATENT DOCUMENTS

CN 101258257 A 9/2008
CN 101775545 * 7/2010
(Continued)

OTHER PUBLICATIONS

The International Search Report from PCT/CN2013/071185, dated May 16, 2013 (English Translation).
(Continued)

*Primary Examiner* — Matthew E Hoban
(74) *Attorney, Agent, or Firm* — Kilpatrick Townsend & Stockton LLP

(57) ABSTRACT

The invention provides a wear-resistant steel plate, which has the following chemical composition (wt. %): C: 0.22-0.35%, Si: 0.10-0.40%, Mn: 0.60-1.35%, P: ≤0.015%, S: ≤0.010%, Nb: 0.010-0.040%, Al: 0.010-0.080%, B: 0.0006-0.0014%, Ti: 0.005-0.050%, Ca: 0.0010-0.0080%, V≤0.080%, Cr≤0.60%, W≤1.00 wt. %, N≤0.0080%, O≤0.0060%, H≤0.0004%, wherein 0.025%≤Nb+Ti≤0.080%, 0.030%≤Al+Ti≤0.12%, and the balance of Fe
(Continued)

and unavoidable impurities. The method of manufacturing the wear-resistant steel plate comprises the steps of smelting, casting, rolling, post-rolling direct cooling and the like. The wear-resistant steel plate obtained from the above composition and process has high strength, high hardness, good low-temperature toughness, and excellent machinability, and is suitable for quick-wear devices in engineering and mining machinery, such as bucket and scraper transporter, etc.

20 Claims, 2 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C21D 1/60*** | (2006.01) |
| ***C21D 6/00*** | (2006.01) |
| ***C21D 9/46*** | (2006.01) |

(52) U.S. Cl.
CPC ..... *C21D 6/008* (2013.01); *C21D 8/02* (2013.01); *C21D 8/0205* (2013.01); *C21D 8/0226* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/26* (2013.01); *C22C 38/28* (2013.01); *C21D 2211/008* (2013.01)

(58) Field of Classification Search
USPC ..... 420/127
See application file for complete search history.

(56) References Cited

U.S. PATENT DOCUMENTS

| | | | | |
|---|---|---|---|---|
| 2007/0144632 | A1* | 6/2007 | Toyoda | C21D 8/0226 148/593 |
| 2008/0156400 | A1* | 7/2008 | Nakashima | C21C 7/0006 148/331 |
| 2010/0059150 | A1 | 3/2010 | Saitoh | |
| 2013/0206286 | A1 | 8/2013 | Ueda et al. | |
| 2013/0216422 | A1* | 8/2013 | Ueda | C21D 8/02 420/83 |
| 2014/0090755 | A1* | 4/2014 | Ueda | C22C 38/02 148/645 |
| 2014/0124102 | A1 | 5/2014 | Zhang et al. | |

FOREIGN PATENT DOCUMENTS

| | | | |
|---|---|---|---|
| CN | 101775545 | A | 7/2010 |
| CN | 101948987 | A | 1/2011 |
| CN | 102560272 | A | 7/2012 |
| CN | 102876969 | A | 1/2013 |
| EP | 1930459 | A1 | 6/2008 |
| JP | H09118950 | A | 5/1997 |
| JP | 3273404 | B2 | 4/2002 |
| JP | 2007260705 | A | 10/2007 |
| JP | 2009030094 | A | 2/2009 |
| JP | 2011214120 | A | 10/2011 |
| JP | 2012-031510 | A | 2/2012 |
| WO | 2012002563 | A1 | 1/2012 |

OTHER PUBLICATIONS

CN2012102700605.3, First Office Action, dated Sep. 23, 2013, pp. 1-11.
CN20121027006053, Search Report, dated Sep. 23, 2013, pp. 1-2.
CN20121027006053, Supplemental Search Report, dated Sep. 30, 2014, pp. 1.
EP13826542, Extended European Search Report, dated Mar. 18, 2016, pp. 1-8.
JP2015-524603, Office Action, dated Jan. 10, 2017, pp. 1-6.
NZ630918, Examination Report, dated Jun. 9, 2015, pp. 1-2.

* cited by examiner

ULTRAHIGH-STRENGTH, HIGH-TOUGHNESS, WEAR-RESISTANT STEEL PLATE AND MANUFACTURING METHOD THEREOF

TECHNICAL FIELD

The invention relates to wear-resistant steel, in particular to a low-alloy, ultrahigh-strength, high-toughness, wear-resistant steel plate and a method for manufacturing the same.

BACKGROUND

A wear-resistant steel plate is widely used for mechanical products for use in engineering, mining, agriculture, cement production, harbor, electric power, metallurgy and the like wherein operating conditions are particularly awful and high strength as well as high wear resistance performances are required. For example, a bulldozer, a loader, an excavator, a dump truck and a grab bucket, a stacker-reclaimer, a delivery bend structure, etc. may be mentioned.

In recent decades, the development and application of wear-resistant steel grows quickly. Generally, carbon content is increased and suitable amounts of microelements such as chromium, molybdenum, nickel, vanadium, tungsten, cobalt, boron, titanium and the like are added to enhance the mechanical performances of wear resistant steel by taking full advantage of various strengthening means such as precipitation strengthening, fine grain strengthening, transformation strengthening and dislocation strengthening, inter alia. Since wear-resistant steel is mostly medium carbon, medium-high carbon or high carbon alloy steel, increase of carbon content leads to decreased toughness, and excessively high carbon content exasperates the weldability of steel badly. In addition, increase of alloy content will result in increased cost and degraded weldability. These drawbacks inhibit further development of wear-resistant steel.

Notwithstanding the wear resistance of a material mainly depends on its hardness, roughness has important influence on the wear resistance of the material, too. Under complicated working conditions, good wear resistance and long service life of a material can not be guaranteed by increasing the hardness of the material alone. Adjusting the components and thermal treatment process, and controlling the appropriate matching between the hardness and roughness of low-alloy wear-resistant steel, may result in superior comprehensive mechanical performances, so that the requirements of different wearing conditions may be satisfied.

Welding is a greatly important processing procedure and plays a vital role in engineering application as it can realize joining between various steel materials. Weld cold cracking is the most common welding process flaw. Particularly, cold cracking has a great tendency to occur when high-strength steel is welded. Generally, preheating before welding and thermal treatment after welding are used to prevent cold cracking, which complicates the welding process, renders the process inoperable in special cases, and imperils the safety and reliability of the welded structure. For high-strength, high-hardness, wear-resistant steel plates, the welding-related problems are particularly prominent.

CN1140205A has disclosed a wear-resistant steel having medium carbon and medium alloy, the contents of carbon and alloy elements (Cr, Mo, etc.) of which are far higher than those of the present invention, which will inevitably lead to poor weldability and machinability.

CN1865481A has disclosed a wear-resistant bainite steel which has higher contents of alloy elements (Si, Mn, Cr, Mo, etc.), and poorer welding and mechanical properties in comparison with the present invention.

SUMMARY

The object of the invention is to provide a low-alloy, ultrahigh-strength, high-toughness, wear-resistant steel plate having the combined properties of high strength, high hardness and high derived from trace amount of alloy elements, so as to achieve superior machining property which benefits the wide application of the steel plate in engineering.

In order to realize the above object, the low-alloy, ultrahigh-strength, high-toughness, wear-resistant steel plate according to the invention comprises the following chemical components in weight percentages: C: 0.22-0.35%, Si: 0.10-0.40%, Mn: 0.60-1.35%, P: ≤0.015%, S: ≤0.010%, Nb: 0.010-0.040%, Al: 0.010-0.080%, B: 0.0006-0.0014%, Ti: 0.005-0.050%, Ca: 0.0010-0.0080%, V≤0.080%, Cr≤0.60%, W≤1.00 wt. %, N≤0.0080%, O≤0.0060%, H≤0.0004%, wherein 0.025%≤Nb+Ti≤0.080%, 0.030%≤Al+Ti≤0.12%, and the balance of Fe and unavoidable impurities.

The wear-resistant steel according to the invention has a microstructure mainly consisted of martensite and residual austenite, wherein the volume fraction of the residual austenite is ≤5%.

Another object of the invention is to provide a method of manufacturing the low-alloy, ultrahigh-strength, high-toughness, wear-resistant steel plate, wherein the method comprises in sequence the steps of smelting, casting, heating, rolling and post-rolling direct cooling, etc. In the heating step, the material is heated to a temperature of 1000-1200° C. In the rolling step, the initial rolling temperature is 950-1150° C. and the end rolling temperature is 800-950° C. In the post-rolling direct cooling step, water cooling is used and the cooling-interruption temperature is from room temperature to 300° C.

Owing to the scientifically designed contents of carbon and alloy elements according to the invention, the steel plate has excellent mechanical properties (strength, hardness, elongation, impact resistance, inter alia), weldability and wear resistance resulting from the refining and strengthening function of the trace alloy elements as well as the control over the refining and strengthening effect of rolling and cooling processes.

The invention differs from the prior art mainly in the following aspects:

In terms of chemical components, the wear-resistant steel according to the invention incorporates small amounts of such elements as Nb, etc. into its chemical composition in addition to C, Si, Mn and the like, and thus is characterized by simple composition, low cost, etc.

In terms of production process, a TMCP process is used to produce the wear-resistant steel according to the invention without off-line quenching, tempering and other thermal treatment procedures, and thus is characterized by a short production flow, high production efficiency, reduced energy consumption, lower production cost, etc.

In terms of product properties, the wear-resistant steel according to the invention exhibits high strength, high hardness, and particularly good low-temperature toughness.

In terms of microstructure, the microstructure of the wear-resistant steel according to the invention mainly comprises fine martensite and residual austenite, wherein the volume fraction of the residual austenite is ≤5%, which facilitates the good matching between the strength, hardness and toughness of the wear-resistant steel plate.

The wear-resistant steel plate according to the invention has relatively remarkable advantages. As the development of social economy and steel industry is concerned, an inevitable trend is the control of the contents of carbon and alloy elements, and the development of low-cost wear-resistant steel having good mechanical properties via a simple process.

DETAILED DESCRIPTION

Figure 1:
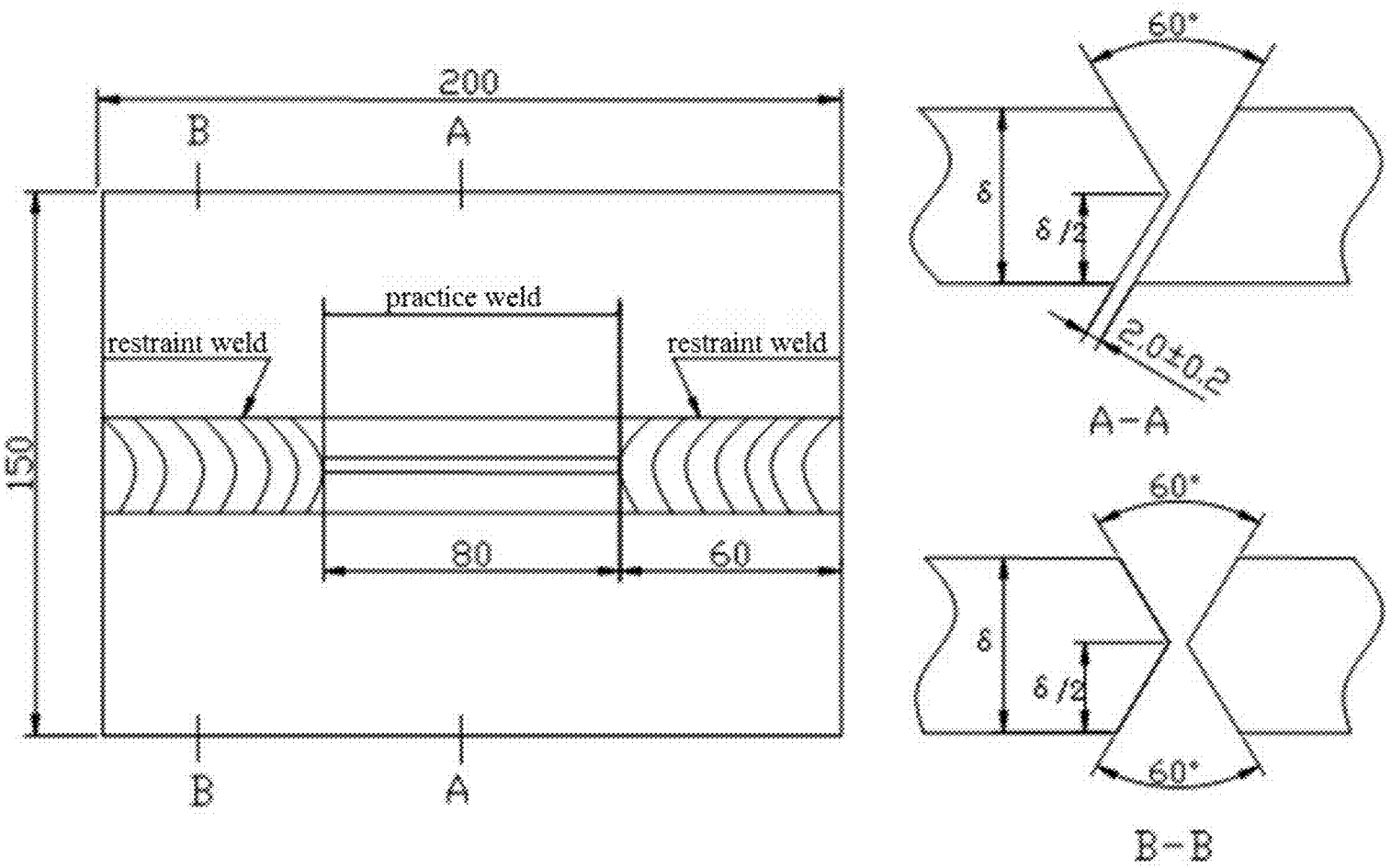
FIG. 1 shows the shape and size of a Y-groove weld cracking test coupon in a welding test.

The properties of the low-alloy, ultrahigh-strength, high-toughness, wear-resistant steel plate according to the invention will be described in detail with reference to the following examples.

By scientifically designing elemental species and contents thereof, the steel type according to the invention has achieved good matching between high strength, high hardness and high toughness on the basis of the addition of trace amounts of alloy elements.

Carbon: carbon is the most basic and important element in wear-resistant steel. It can improve the strength and hardness of the steel, and further improve the wear resistance of the steel. However, it may deteriorate the toughness and weldability of the steel. Hence, the carbon content in the steel shall be reasonably controlled to be 0.22-0.35%, preferably 0.23-0.33%.

Silicon: silicon forms a solid solution in ferrite and austenite to improve their hardness and strength. However, excessive silicon will decrease the steel toughness sharply. Meanwhile, due to better affinity of silicon to oxygen than to iron, silicate having low melting point tends to be generated easily during welding, which increases slag and the mobility of molten metals, and thus impacts the quality of the weld. Therefore, it is undesirable to have excessive silicon. The content of silicon in the invention is controlled to be 0.10-0.40%, preferably 0.10-0.35%.

Manganese: manganese increases the hardenability of steel mightily, and lowers the transition temperature of wear-resistant steel and the critical cooling rate of steel. However, higher content of manganese tends to coarsen the grains, increase the temper embrittlement sensitivity of the steel, increase the tendency of segregation and cracking in the cast billet, and degrade the performance properties of the steel plate. In the invention, the content of manganese is controlled to be 0.60-1.35%, preferably 0.65-1.30%.

Niobium: the function of Nb in grain refining and precipitation strengthening contributes significantly to increased strength and toughness of the material. As an element having a strong propensity to form carbide and nitride, niobium restrains the growth of austenite grains consumingly. Nb increases both the strength and toughness of steel by refining grains. Nb ameliorates and enhances the properties of steel mainly by way of precipitation strengthening and transformation strengthening Nb has already been viewed as one of the most effective strengthening agents in HSLA steel. In the invention, niobium is controlled to be 0.010-0.040%, preferably 0.010-0.035%.

Aluminum: aluminum and nitrogen in steel can form insoluble fine AlN particles to refine steel grains. Aluminum can refine steel grains, immobilize nitrogen and oxygen in the steel, lessen the notch sensitivity of the steel, reduce or eliminate the aging phenomenon of the steel, and enhance the toughness of the steel. In the invention, the content of Al is controlled to be 0.010-0.080%, preferably 0.010-0.060%.

Boron: boron improves the hardenability of steel, but excessive content will lead to hot shortness, and impact the weldability and hot workability of the steel. In the invention, the content of boron is strictly controlled to be 0.0006-0.0014%, preferably 0.0008-0.0014%.

Titanium: titanium is one of the elements having a strong tendency to form carbides, and forms fine TiC particles with carbon. TiC particles are very small, and are distributed along the crystal boundary, so as to have the effect of refining grains. Hard TiC particles improve the wear resistance of the steel. In the invention, titanium is controlled to be 0.005-0.050%, preferably 0.010-0.045%.

The addition of niobium and titanium in combination may result in better effect in grain refining, reducing the grain size of the original austenite, favoring the formation of martensite laths after refining and quenching, and increasing the strength and wear resistance. The insolubility of TiN and the like at high temperature may prevent grains in the heat affect zone from coarsening, and enhance the toughness of the heat affect zone, so as to improve the weldability of the steel. Hence, the contents of niobium and titanium meet the following relationship: 0.025%≤Nb+Ti≤0.080%, preferably 0.035%≤Nb+Ti≤0.070%.

Titanium can form fine particles and thus refine crystal grains. Aluminum may guarantee the formation of fine titanium particles, so that titanium may play a full role in refining grains. Hence, the content ranges of aluminum and titanium meet the following relationship: 0.030%≤Al+Ti≤0.12%, preferably 0.040%≤Al+Ti≤0.11%.

Calcium: calcium has a remarkable effect on the transformation of the inclusions in cast steel. Addition of a suitable amount of calcium in cast steel may transform the long-strip like sulfide inclusions in the cast steel into spherical CaS or (Ca, Mn)S inclusions. Oxide and sulfide inclusions formed from calcium have smaller densities, and thus are easier for floatation and removal. Calcium can also notably inhibit the clustering of sulfur along the crystal boundary. All of these are favorable for increasing the quality of the cast steel, and thus improving the performances of the steel. When there are a relatively large amount of inclusions, the addition of calcium shows obvious effect, and is helpful for guaranteeing the mechanical properties of the steel, in particular toughness. In the invention, calcium is controlled to be 0.0010-0.0080%, preferably 0.0010-0.0060%.

Vanadium: vanadium is added mainly for refining grains, so that austenite grains will not grow unduly in the stage of billet heating. As such, in the subsequent several runs of rolling, the steel grains may be further refined to increase the strength and toughness of the steel. In the invention, vanadium is controlled to be ≤0.080%, preferably 0.035-0.080%, still preferably ≤0.060%.

Chromium: chromium may slow the critical cooling rate and enhance the hardenability of the steel. Several carbides, such as $(Fe,Cr)_3C$, $(Fe,Cr)_7C_3$ and $(Fe,Cr)_{23}C_7$, etc., may be formed from chromium in the steel to improve strength and hardness. During tempering, chromium can prevent or slow down the precipitation and aggregation of the carbides, so that the tempering stability of the steel can be increased. In the invention, the chromium content is controlled to be ≤0.60%, preferably 0.20-0.60%, still preferably ≤0.40%.

Tungsten: tungsten may increase the tempering stability and hot strength of the steel, and may have certain effect in refining grains. In addition, tungsten may form hard carbide to improve the wear resistance of the steel. In the invention, the tungsten content is controlled to be ≤1.00%, preferably 0.30-1.00%, still preferably ≤0.80%.

Phosphorus and sulfur: sulfur and phosphorus are both harmful elements in wear-resistant steel. Their contents have to be controlled strictly. In the steel of the type according to the invention, the phosphorus content is controlled to be ≤0.015%, preferably ≤0.010%; and sulfur content is ≤0.010%, preferably ≤0.005%.

Nitrogen, oxygen and hydrogen: excessive oxygen and nitrogen in steel are quite undesirable for the properties of the steel, especially weldability and toughness. However, overly strict control will increase the production cost to a great extent. Therefore, in the steel of the type according to the invention, the nitrogen content is controlled to be ≤0.0080%, preferably ≤0.0050%; the oxygen content is ≤0.0060%, preferably ≤0.0040%; and the hydrogen content is ≤0.0004%, preferably ≤0.0003%.

The method of manufacturing the above low-alloy, ultra-high-strength, high-toughness, wear-resistant steel plate according to the invention comprises in sequence the steps of smelting, casting, heating, rolling and post-rolling direct cooling, etc. In the heating step, the material is heated to a temperature of 1000-1200° C. In the rolling step, the initial rolling temperature is 950-1150° C. and the end rolling temperature is 800-950° C. In the cooling step, water cooling is used and the cooling-interruption temperature is from room temperature to 300° C.

Preferably, in the heating process, the heating temperature is 1000-1150° C., more preferably 1000-1130° C. In order to guarantee the sufficient diffusion of carbon and alloy elements, and to prevent excessive growth of the austenite grains and severe oxidation of the billet surface, the heating temperature is most preferably 1050-1130° C.

Preferably, the initial rolling temperature: 950-1100° C.; the end rolling temperature: 800-900° C.; more preferably, the initial rolling temperature: 950-1080° C.; the end rolling temperature: 810-900° C.; and most preferably, the initial rolling temperature: 980-1080° C.; the end rolling temperature: 810-890° C.

Preferably, the cooling-interruption temperature is from room temperature to 280° C., more preferably from room temperature to 250° C., most preferably from room temperature to 200° C.

The contents of carbon and microalloy are controlled strictly according to the invention by reasonably designing the chemical composition (the contents and ratios of C, Si, Mn, Nb and other elements). The wear-resistant steel plate obtained from such a designed composition has good weldability and is suitable for application in the engineering and mechanical fields where welding is needed. Additionally, the production cost of wear-resistant steel is decreased greatly due to the absence of such elements as Mo, Ni and the like.

The wear-resistant steel plate according to the invention has high strength, high hardness and good impact toughness, inter alia, is easy for machining such as cutting, bending, etc., and has very good applicability.

The low-alloy, ultrahigh-strength, high-toughness, wear-resistant steel plate produced according to the invention has a tensile strength of 1400-1700 MPa, an elongation of 13-14%, a Brinell hardness of 470-570HBW, and preferably a Charpy V-notch longitudinal impact work at −40° C. of 50-80 J. It has good weldability and excellent mechanical properties, leading to improved applicability of the wear-resistant steel.

EXAMPLES

Table 1 shows the mass percentages of the chemical elements in the steel plates according to Examples 1-7 of the invention and Comparative Example 1 (CN1865481A).

The raw materials for smelting were subjected to the manufacturing process according to the following steps: smelting→casting→heating→rolling→post-rolling direct cooling.

The specific process parameters for Examples 1-7 are shown in Table 2.

TABLE 1

Chemical compositions of Examples 1-7 according to the present invention and Comparative Example 1 (in wt. %)

| | C | Si | Mn | P | S | Nb | Al | B | Ti |
|---|---|---|---|---|---|---|---|---|---|
| Ex. 1 | 0.22 | 0.25 | 1.35 | 0.009 | 0.005 | 0.027 | 0.020 | 0.0013 | 0.010 |
| Ex. 2 | 0.23 | 0.40 | 1.30 | 0.015 | 0.004 | 0.040 | 0.051 | 0.0012 | 0.005 |
| Ex. 3 | 0.25 | 0.35 | 1.05 | 0.010 | 0.010 | 0.035 | 0.038 | 0.0008 | 0.045 |
| Ex. 4 | 0.28 | 0.23 | 0.93 | 0.008 | 0.003 | 0.010 | 0.080 | 0.0006 | 0.040 |
| Ex. 5 | 0.30 | 0.28 | 0.88 | 0.009 | 0.003 | 0.020 | 0.060 | 0.0014 | 0.050 |
| Ex. 6 | 0.33 | 0.10 | 0.65 | 0.008 | 0.002 | 0.018 | 0.010 | 0.0013 | 0.030 |
| Ex. 7 | 0.35 | 0.22 | 0.60 | 0.009 | 0.003 | 0.021 | 0.045 | 0.0012 | 0.027 |
| Comp. 1 | 0.40 | 1.12 | 2.26 | <0.04 | <0.03 | — | — | — | — |

| | Ca | V | Cr | W | N | O | H | Others |
|---|---|---|---|---|---|---|---|---|
| Ex. 1 | 0.0030 | 0.060 | 0.23 | 0.32 | 0.0038 | 0.0040 | 0.0003 | — |
| Ex. 2 | 0.0060 | 0.080 | / | 1.00 | 0.0080 | 0.0025 | 0.0004 | — |
| Ex. 3 | 0.0010 | 0.038 | 0.60 | 0.80 | 0.0037 | 0.0021 | 0.0002 | — |
| Ex. 4 | 0.0050 | / | 0.40 | / | 0.0025 | 0.0060 | 0.0002 | — |
| Ex. 5 | 0.0080 | / | / | / | 0.0050 | 0.0027 | 0.0003 | — |
| Ex. 6 | 0.0030 | 0.051 | 0.27 | 0.50 | 0.0033 | 0.0033 | 0.0002 | — |
| Ex. 7 | 0.0020 | 0.035 | 0.38 | 0.46 | 0.0029 | 0.0029 | 0.0002 | — |
| Comp. 1 | | — | 1.0 | — | — | — | | Mo: 0.8 |

TABLE 2

Specific process parameters for Examples 1-7 according to the invention

| | Slab heating temperature ° C. | Holding time h | Initial rolling temperature ° C. | End rolling temperature ° C. | Cooling method | Cooling interruption temperature ° C. | Steel plate thickness mm |
|---|---|---|---|---|---|---|---|
| Ex. 1 | 1000 | 2 | 950 | 800 | Water cooling | 200 | 12 |
| Ex. 2 | 1130 | 2 | 1105 | 822 | Water cooling | 300 | 26 |
| Ex. 3 | 1050 | 2 | 980 | 810 | Water cooling | 250 | 15 |
| Ex. 4 | 1100 | 2 | 1020 | 833 | Water cooling | 128 | 31 |
| Ex. 5 | 1110 | 2 | 1080 | 853 | Water cooling | 56 | 22 |
| Ex. 6 | 1150 | 2 | 1120 | 900 | Water cooling | Room temperature | 19 |
| Ex. 7 | 1200 | 2 | 1150 | 950 | Water cooling | 75 | 16 |

Test 1: Test for Mechanical Properties

Sampling was conducted according to the sampling method described in GB/T2975, and the low-alloy, ultra-high-strength, high-toughness, wear-resistant steel plates of Examples 1-7 of the invention were subjected to hardness test according to GB/T231.1; impact test according to GB/T229; tensile test according to GB/T228; and bending test according to GB/T232. The results are shown in Table 3.

TABLE 3

Mechanical properties of Examples 1-7 of the present invention and Comparative Example 1

| | | | Lateral tensile properties | | Charpy V-notch |
|---|---|---|---|---|---|
| | 90° Cold bending D = 3a | Hardness HBW | Tensile strength MPa | Elongation % | longitudinal impact work (−40° C.), J |
| Ex. 1 | Pass | 472 | 1435 | 14% | 75 |
| Ex. 2 | Pass | 483 | 1490 | 14% | 71 |
| Ex. 3 | Pass | 499 | 1505 | 14% | 67 |
| Ex. 4 | Pass | 515 | 1520 | 13% | 69 |
| Ex. 5 | Pass | 526 | 1565 | 13% | 67 |
| Ex. 6 | Pass | 542 | 1625 | 13% | 63 |
| Ex. 7 | Pass | 563 | 1680 | 13% | 51 |
| Comp. 1 | — | About 400 (HRC43) | 1250 | 10 | — |

As can be seen from Table 3, the steel plates of Examples 1-7 of the present invention exhibit 1400-1700 MPa of tensile strength, 13%-14% of elongation, 470-570HBW of Brinell hardness, and 50-80 J of Charpy V-notch longitudinal impact work at −40° C. This indicates that the steel plates of the invention not only are characterized by high strength, high hardness, good elongation, inter alia, but also have excellent low-temperature impact toughness. Obviously, the steel plates of the invention are superior over Comparative Example 1 in terms of strength, hardness and elongation.

Figure 2:
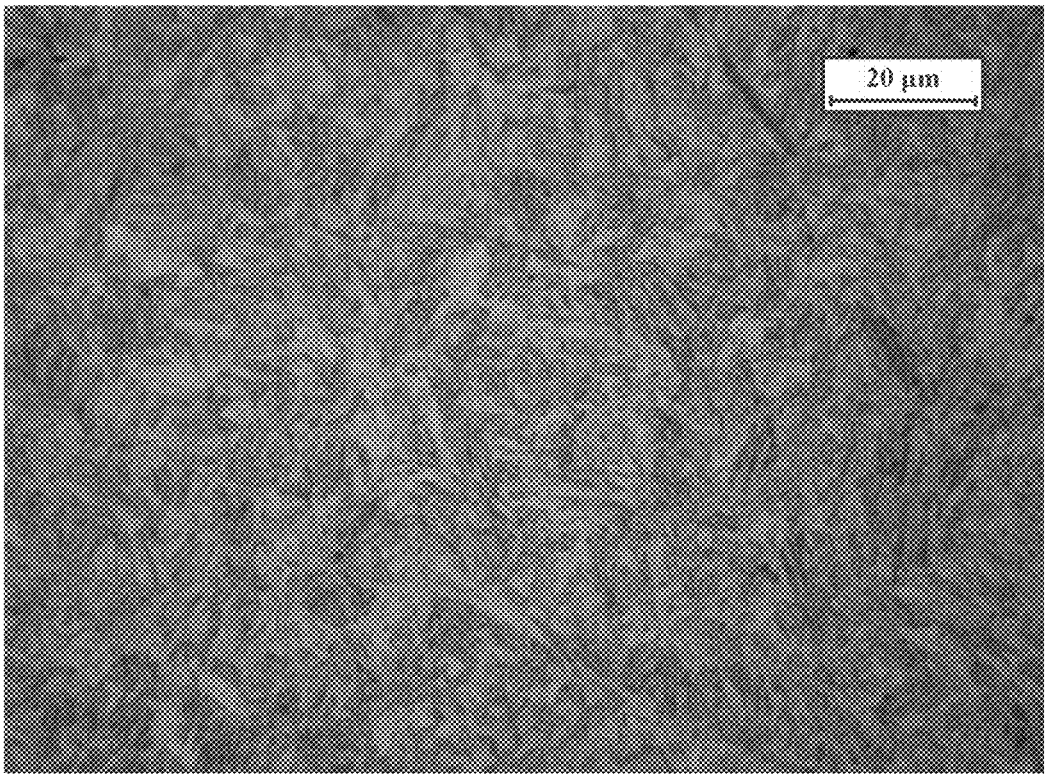
FIG. 2 shows the microstructure of the steel plate according to Example 3, which comprises fine martensite and a small amount of residual austenite and guarantees that the steel plate has good mechanical properties.

FIG. 2 shows the microstructure of the steel plate according to Example 3, which comprises fine martensite and a small amount of residual austenite and guarantees that the steel plate has good mechanical properties.

Similar microstructures were obtained for the other examples.

Test 2: Test for Weldability

The wear-resistant steel plates of the invention were divided into five groups and subjected to Y-groove weld cracking test according to Testing Method for Y-groove Weld Cracking (GB4675.1-84). The shape and size of a Y-groove weld cracking test coupon is shown in FIG. 1.

Firstly, restraint welds were formed. The restraint welds were formed using JM-58 welding wires (Φ1.2) through Ar-rich gas shielded welding method. During welding, angular distortion of the coupon was controlled strictly. Subsequent to the welding, the practice weld was formed after cooling to room temperature. The practice weld was formed at room temperature. After 48 hours since the practice weld was finished, the weld was examined for surface cracks, section cracks and root cracks. After dissection, a coloring method was used to examine the surface, section and root of the weld respectively. The welding condition was 170A×25V×160 mm/min.

The low-alloy, ultrahigh-strength, high-toughness, wear-resistant steel plates of Examples 1-7 of the invention were tested for weldability. The test results are shown in Table 4.

TABLE 4

Test results of weldability of Examples 1-7 of the present invention

| | Pre-heating temperature | Coupon No. | Surface cracking rate % | Root cracking rate % | Section cracking rate % | Environment temperature | Relative humidity |
|---|---|---|---|---|---|---|---|
| Ex. 1 | 76 | 1 | 0 | 0 | 0 | 28° C. | 66% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |

TABLE 4-continued

Test results of weldability of Examples 1-7 of the present invention

| | Pre-heating temperature | Coupon No. | Surface cracking rate % | Root cracking rate % | Section cracking rate % | Environment temperature | Relative humidity |
|---|---|---|---|---|---|---|---|
| Ex. 2 | 97 | 1 | 0 | 0 | 0 | 31° C. | 59% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 3 | 106 | 1 | 0 | 0 | 0 | 26° C. | 62% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 4 | 115 | 1 | 0 | 0 | 0 | 25° C. | 61% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 5 | 137 | 1 | 0 | 0 | 0 | 35° C. | 66% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 6 | 153 | 1 | 0 | 0 | 0 | 29° C. | 63% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 7 | 175 | 1 | 0 | 0 | 0 | 33° C. | 65% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |

As can be seen from Table 4, none of the steel plates of Examples 1-7 of the present invention exhibits cracking after welding under certain preheating conditions, indicating that the wear-resistant steel plates of the present invention have good weldability.

Test 3: Test for Wear Resistance

The wear resistance test was performed on an ML-100 abrasive-wear tester. A sample was cut out with the axis thereof being perpendicular to the surface of the steel plate, so that the wearing surface of the sample was the rolling surface of the steel plate. The sample was machined as required into a stepwise cylinder, wherein the size of the testing part was Φ4 mm, and the size of the holding part for a fixture was Φ5 mm Before testing, the sample was washed with alcohol, dried with a blower, and weighed on a balance having a precision of 1/10000 for the sample weight which was used as the original weight. Then, the sample was mounted on a flexible fixture. The test was conducted using an 80 mesh sand paper at a 42 N load. After testing, due to the abrasion between the sample and the sand paper, the sample scribed a spiral line on the sand paper. The length of the spiral line was calculated from the initial and final radii of the spiral line according to the following formula:

$$S = \frac{\pi(r_1^2 - r_2^2)}{a}$$

wherein r1 is the initial radius of the spiral line, r2 is the final radius of the spiral line, and a is the feed rate of the spiral line. In each experiment, the sample was weighed three times and an averaged. Then, the weight loss was calculated, and the weight loss per meter was used to represent the wear rate (mg/M) of the sample.

The low-alloy, ultrahigh-strength, high-toughness, wear-resistant steel plates of Examples 1-7 of the present invention were tested for wear resistance. Table 5 shows the wear testing results of the steel type in the Examples of the invention and the steel in Comparative Example 2 (the hardness of the steel plate of Comparative Example 2 was 450HBW).

TABLE 5

Wear testing results of Examples 1-7 of the present invention and Comparative Example 2

| Steel type | Testing temperature | Wear testing conditions | Wear rate (mg/M) |
|---|---|---|---|
| Ex. 1 | Room temperature | 80 mesh sand paper/ 42N load | 8.112 |
| Ex. 2 | Room temperature | 80 mesh sand paper/ 42N load | 7.892 |
| Ex. 3 | Room temperature | 80 mesh sand paper/ 42N load | 7.667 |
| Ex. 4 | Room temperature | 80 mesh sand paper/ 42N load | 7.308 |
| Ex. 5 | Room temperature | 80 mesh sand paper/ 42N load | 7.002 |
| Ex. 6 | Room temperature | 80 mesh sand paper/ 42N load | 6.796 |
| Ex. 7 | Room temperature | 80 mesh sand paper/ 42N load | 6.503 |
| Comp. 2 | Room temperature | 80 mesh sand paper/ 42N load | 9.625 |

As can be seen from Table 5, under such wearing conditions, the low-alloy, ultrahigh-strength, high-toughness, wear-resistant steel plates of the invention have better wear resistance than the steel plate of Comparative Example 2.

The wear-resistant steel according to the invention incorporates small amounts of such elements as Nb, etc. into its chemical composition in addition to C, Si, Mn and like elements, and thus is characterized by simple composition, low cost, etc. A TMCP process is used in the production according to the invention without off-line quenching, tempering and other thermal treatment procedures, and thus is characterized by a short production flow, high production efficiency, reduced energy consumption, lower production cost, etc. The wear-resistant steel plate according to the invention has high strength, high hardness and especially good low-temperature toughness. The microstructure of the wear-resistant steel according to the invention mainly comprises fine martensite and residual austenite, wherein the volume fraction of the residual austenite is ≤5%. The wear-resistant steel has a tensile strength of 1400-1700 MPa, an elongation rate of 13-14%, a Brinell hardness of 470-570HBW, and a Charpy V-notch longitudinal impact work at −40° C. of 50-80 J. Hence, good matching between strength, hardness and toughness of the wear-resistant steel plate is favored. Therefore, the wear-resistant steel plate of the invention shows obvious advantages.

What is claimed is:

1. A wear-resistant steel plate, consisting essentially of the following chemical components in weight percentages: C: 0.22-0.35%, Si: 0.10-0.40%, Mn: 0.60-1.35%, P≤0.015%, S≤0.010%, Nb: 0.010-0.040%, Al: 0.010-0.080%, B: 0.0006-0.0014%, Ti: 0.005-0.050%, Ca: 0.0010-0.0080%, V≤0.080%, Cr≤0.60%, W≤1.00%, N≤0.0080%, O≤0.0060%, H≤0.0004%, wherein the total amount of Nb and Ti is between 0.025% and 0.080%, the total amount of Al and Ti is between 0.030% and 0.12%, and the balance is of Fe and unavoidable impurities.

2. The wear-resistant steel plate of claim 1, wherein C: 0.23-0.33%.

3. The wear resistant steel plate of claim 1, wherein Si: 0.10-0.35%.

4. The wear-resistant steel plate of claim 1, wherein Mn: 0.65-1.30%.

5. The wear-resistant steel plate of claim 1, wherein P≤0.010%.

6. The wear-resistant steel plate of claim 1, wherein S≤0.005%.

7. The wear-resistant steel plate of claim 1, wherein Nb: 0.010-0.035%.

8. The wear-resistant steel plate of claim 1, wherein Al: 0.020-0.060%.

9. The wear-resistant steel plate of claim 1, wherein B: 0.0008-0.0014%.

10. The wear-resistant steel plate of claim 1, wherein Ti: 0.010-0.045%.

11. The wear-resistant steel plate of claim 1, wherein Ca: 0.0010-0.0060%.

12. The wear-resistant steel plate of claim 1, wherein V≤0.060%.

13. The wear-resistant steel plate of claim 1, wherein Cr≤0.40%.

14. The wear-resistant steel plate of claim 1, wherein W≤0.80 wt. %.

15. The wear-resistant steel plate of claim 1, wherein N≤0.0050%.

16. The wear-resistant steel plate of claim 1, wherein O≤0.0040% and H≤0.0003%.

17. The wear-resistant steel plate of claim 1, wherein the total amount of Nb and Ti is between 0.035% and 0.070%, and the total amount of Al and Ti is between 0.040% and 0.11%.

18. The wear resistant steel plate of claim 1, wherein the steel plate has the following properties: the tensile strength is 1400-1700 MPa; the elongation is 13%-14%; the Brinell hardness is 470-570HBW; and the Charpy V-notch longitudinal impact work at −40° C. is 50-80J.

19. A method of manufacturing the wear-resistant steel plate of claim 1, comprising in sequence the steps of smelting, casting, heating, rolling and post-rolling direct cooling, wherein:

in the heating step, the heating temperature is 1000-1200° C. and the hold time is 1-2 hours;

in the rolling step, the initial rolling temperature is 950-1150° C. and the end rolling temperature is 800-950° C.; and in the post-rolling direct cooling step, water cooling is used and the cooling interruption temperature is from room temperature to 300° C.

20. The method of manufacturing the wear-resistant steel plate according to claim 19, wherein:

in the heating step, the hold time is 2 hours;

in the heating step, the temperature for heating a slab is 1000-1150° C.;

in the rolling step, the initial rolling temperature is 950-1100° C. and the end rolling temperature is 800-900° C.; or in the post-rolling direct cooling step, the cooling interruption temperature is from room temperature to 280° C.

* * * * *